US012779273B2

(12) United States Patent
Weng et al.

(10) Patent No.: US 12,779,273 B2
(45) Date of Patent: Nov. 3, 2026

(54) GUIDE SHAFT, DUMBBELL, AND METHOD FOR ASSEMBLING AND DISASSEMBLING COUNTER WEIGHTS OF DUMBBELL

(71) Applicants: Zhejiang Qili Health Technology Ltd., Jinhua (CN); Ningbo Tidal Industrial Design Co., Ltd, Ningbo (CN)

(72) Inventors: Gaowang Weng, Jinhua (CN); Zhan Li, Ningbo (CN)

(73) Assignees: Zhejiang Qili Health Technology Ltd., Jinhua (CN); Ningbo Tidal Industrial Design Co., Ltd, Ningbo (CN)

( * ) Notice: Subject to any disclaimer, the term of this patent is extended or adjusted under 35 U.S.C. 154(b) by 59 days.

(21) Appl. No.: 18/896,270

(22) Filed: Sep. 25, 2024

(65) Prior Publication Data

US 2026/0054123 A1 Feb. 26, 2026

(30) Foreign Application Priority Data

Aug. 22, 2024 (CN) ..... 202411157497.8
Aug. 22, 2024 (CN) ..... 202422041682.2

(51) Int. Cl.
*A63B 21/075* (2006.01)
*A63B 21/072* (2006.01)
*A63B 71/00* (2006.01)

(52) U.S. Cl.
CPC ..... *A63B 21/075* (2013.01); *A63B 21/0726* (2013.01); *A63B 21/0728* (2013.01); *A63B 71/0036* (2013.01)

(58) Field of Classification Search
CPC ..... A63B 21/075; A63B 21/0726; A63B 21/0728; A63B 71/0036
See application file for complete search history.

(56) References Cited

U.S. PATENT DOCUMENTS 6,416,446 B1 * 7/2002 Krull ..... A63B 21/0628 482/107
12,076,605 B2 * 9/2024 Sun ..... A63B 21/0726
(Continued)

FOREIGN PATENT DOCUMENTS

CN 206473710 U 9/2017
CN 217724452 U 11/2022

*Primary Examiner* — Andrew S Lo

(57) ABSTRACT

The present disclosure belongs to the technical field of sports equipment and discloses a dumbbell with conveniently assembled and disassembled counter weights and an assembling and disassembling method thereof. The dumbbell includes a center rod, where both ends of the center rod are connected with mounting bases. The dumbbell further includes a pedestal and counter weights, where each of the mounting bases is provided with a plurality of mounting cavities, and the counter weights and the mounting cavities are hooked or disassembled through the rotation of the center rod. The dumbbell further includes a guide shaft that passes through the mounting bases and is connected to the center rod, where at least one annular guide groove and a compound counter weight guide groove are formed in a peripheral surface of the guide shaft, and each guide groove corresponds to one mounting cavity.

1 Claim, 4 Drawing Sheets

(56) References Cited

U.S. PATENT DOCUMENTS

| | | | | |
|---|---|---|---|---|
| 2006/0189458 | A1* | 8/2006 | Walkerdine | A63B 21/0728 482/106 |
| 2007/0184945 | A1* | 8/2007 | Lin | A63B 21/075 482/107 |
| 2007/0254785 | A1* | 11/2007 | Lin | A63B 21/0728 482/108 |
| 2015/0360073 | A1* | 12/2015 | Moran | A63B 21/075 |
| 2017/0001061 | A1* | 1/2017 | Marjama | A63B 71/0036 |
| 2023/0031956 | A1* | 2/2023 | Luo | A63B 21/0726 |
| 2023/0264067 | A1* | 8/2023 | Wang | A63B 21/0726 |
| 2023/0347198 | A1* | 11/2023 | Hong | A63B 21/0728 |
| 2024/0252873 | A1* | 8/2024 | Pohl | A63B 21/0728 |
| 2024/0285995 | A1* | 8/2024 | Cheng | A63B 21/0728 |
| 2024/0408434 | A1* | 12/2024 | Liu | A63B 71/0036 |

* cited by examiner

GUIDE SHAFT, DUMBBELL, AND METHOD FOR ASSEMBLING AND DISASSEMBLING COUNTER WEIGHTS OF DUMBBELL

CROSS-REFERENCE TO RELATED APPLICATIONS

This application claims priority from the Chinese patent application 2024111574978 filed Aug. 22, 2024, and from Chinese patent application 2024220416822 filed Aug. 22, 2024, the content of which are incorporated herein in the entirety by reference.

TECHNICAL FIELD

The present disclosure relates to the technical field of sports equipment and particularly relates to a guide shaft, a dumbbell, and a method for assembling and disassembling counter weights of the dumbbell.

BACKGROUND

A dumbbell, an auxiliary appliance for weightlifting and fitness exercises, is used to enhance muscular strength training. Thanks to a bell-like structure and no sound made during exercise, it is named dumbbell. To improve the applicability of the dumbbell to adapt to groups with different weight requirements, a dumbbell with adjustable weight appears. An easily disassembled dumbbell includes a center rod, baffle rings, a plurality of counter weights, and retaining members, where the baffle rings are fixed at both ends of the center rod, the plurality of counter weights are sleeved on end portions of both ends of the center rod and one side of each of the counter weights leans against each of the baffle rings, and each of the retaining members is arranged on the other side of each of the counter weights and is sleeved and fixed on each of the end portions of the center rod. When the counter weights on the inner side are disassembled, all counter weights need to be taken down to be disassembled and replaced, so the disassembling process is tedious and difficult to operate.

SUMMARY

To solve the above technical problem, provided is a guide shaft with conveniently assembled and disassembled counter weights.

To achieve the above first object, the technical solution adopted by the present disclosure is as follows: a guide shaft, including a guide shaft body, where at least two annular guide grooves and a compound counter weight guide groove distributed in an axial direction of the guide shaft body are formed in a peripheral surface of the guide shaft body;

there is a wave peak at a rabbet profile of each of the annular guide grooves, and the wave peaks at rabbets of two adjacent annular guide grooves are arranged in a staggered manner; and an adapting ring configured to engage a counter weight is away from or close to a counter weight needed to be assembled to assemble and disassemble the counter weight.

According to the present disclosure, further, there are five annular guide grooves: a first guide groove, a second guide groove, a third guide groove, a fourth guide groove, and a fifth guide groove in sequence, distributed from a direction close to a center rod to a direction away from the center rod;

the first guide groove is the annular guide groove jointly formed by a V-shaped section and a first arc-shaped section, and an opening of the V-shaped section is directed to one end away from the center rod;

the second guide groove is the annular guide groove jointly formed by a U-shaped section and a second arc-shaped section, an opening of the U-shaped section is directed to one end away from the center rod, the width of the opening of the U-shaped section is greater than that of the V-shaped section, and the second guide groove is staggered with the first guide groove in profile;

the third guide groove is the annular guide groove formed by a slope section and a third arc-shaped section, a direction of tilt of the slope section is consistent with a direction of tilt of a vertical portion of the U-shaped section, and the slope section is located on one side of the opening of the U-shaped section;

the fourth guide groove is as same as the second guide groove in structure with opposite opening directions, and an opening of the fourth guide groove and the opening of the second guide groove are formed in a staggered manner; and the fifth guide groove is in a fold line shape formed by connecting a plurality of V-shaped sections and U-shaped sections end to end to hook a compound counter weight.

To achieve a second object of the present disclosure, the present disclosure further provides a dumbbell with conveniently assembled and disassembled counter weights, including adapting rings, where the adapting rings correspond to the annular guide grooves of the guide shaft and are provided with guide structures assembled with the annular guide grooves to mount counter weights and mounting bases.

According to the present disclosure, further, the dumbbell further includes a center rod that provides a handheld area, where both ends of the center rod are connected with the mounting bases that are the same in structure and provided with counter weight mounting cavities, a pedestal for placing the entire dumbbell, and the counter weights placed on a surface of the pedestal, each of the mounting bases is provided with a plurality of mounting cavities arranged in an axial direction of the mounting base to mount the counter weights, and the counter weights and the mounting cavities are hooked or disassembled through rotation of the center rod.

According to the present disclosure, further, each of the guide structures includes a guide stem connected to each of the adapting rings; one end of the guide stem cooperates with the corresponding annular guide groove; and with rotation of the guide shaft, the guide stem drives each of the adapting rings to change along a trend of the rabbet of the annular guide groove to be away from or close to the counter weight needed to be assembled to assemble and disassemble each of the counter weights.

According to the present disclosure, further, a notch with a vertical inner wall is formed at the top of each of the counter weights, a concave arc is formed on the vertical inner wall, and openings of the concave arcs on both sides are formed oppositely to form an accommodating cavity for accommodating each of the adapting rings.

To achieve a third object of the present disclosure, the present disclosure further provides a method for assembling and disassembling a dumbbell with conveniently assembled and disassembled counters including the following steps:

placing a counter weight on a pedestal;

passing a guide shaft through a mounting base and connecting the guide shaft to a center rod;

assembling an annular guide groove provided with a guide structure with an adapting ring arranged at a periphery of the guide shaft; and rotating the center rod to drive the guide shaft to rotate, and driving the adapting ring by the guide structure to change along a trend of a rabbet of the annular guide groove to be away from or close to the counter weight needed to be assembled to assemble and disassemble the counter weight.

Further, in a mounted state, with rotation of the center rod, the adapting ring is hooked with a first guide groove, a second guide groove, a third guide groove, a fourth guide groove and a fifth guide groove in sequence from a direction close to the center rod to a direction away from the center rod to mount the counter weight; and in a disassembled state, the center rod rotates reversely, and the adapting ring is separated from the first guide groove, the second guide groove, the third guide groove, the fourth guide groove and the fifth guide groove in sequence from the direction away from the center rod to the direction close to the center rod to disassemble the counter weight.

Further, the method for assembling and disassembling a dumbbell with conveniently assembled and disassembled counter weights further includes fixing a square block sleeved at the periphery of an end portion of the center rod with a square through hole formed in an end portion of the guide shaft.

Further, the method for assembling and disassembling a dumbbell with conveniently assembled and disassembled counter weights further includes sleeving the end portion of the center rod with an end plate with a cavity, where the cavity faces one side away from the center rod;

uniformly distributing stopping blocks along a peripheral surface of an inner wall of the cavity, where there is a gap between two adjacent stopping blocks; and fixedly connecting one end of a locking block to a vertically upward spring, fixedly connecting the spring to the center rod, and contacting the other end of the locking block with the pedestal, where in an initial state, the spring is in a compressed state, the locking block is away from the gap, and the center rod rotates to assemble and disassemble the counter weight; and in an assembled state, an external force of the spring disappears, and the locking block is embedded into the gap to lock the center rod.

Compared with the prior art, the present disclosure has the following beneficial effects: The guide shaft with the annular guide grooves is rotationally connected to the center rod, and the adapting rings cooperating with the annular guide grooves change a path as the center rod rotates and move toward a direction close to or away from the center rod to mount or disassemble the counter weights.

The fifth guide groove is additionally formed to hook compound counter weights with different counter weights, so that the probability of assembling more counter weights is realized, and the applicability thereof is improved.

Figure 1:
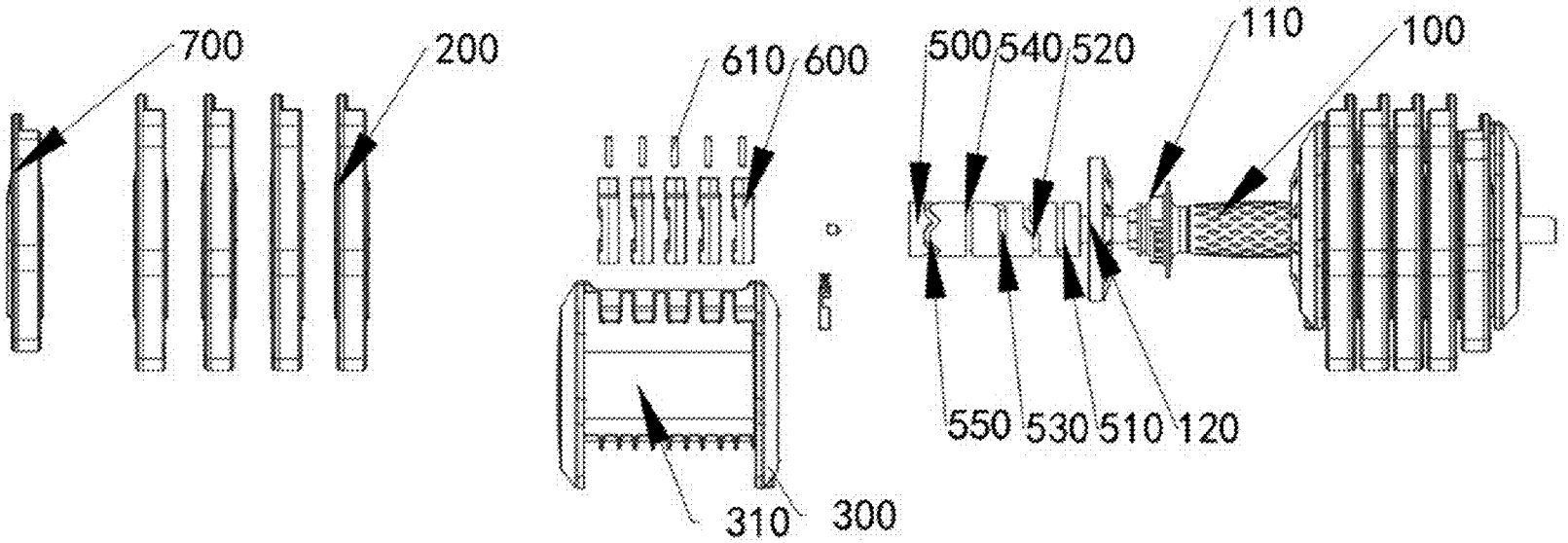
FIG. 1 is a partially exploded schematic structural diagram of a dumbbell with conveniently assembled and disassembled counter weights of the present disclosure.

In the drawings, 100—center rod; 110—square block; 120—end plate; 121—stopping block; 200—counter weight; 210—U—shaped notch; 300—mounting base; 310—mounting cavity; 400—pedestal; 500—guide shaft body; 510—first guide groove; 511—V-shaped section; 512—first arc-shaped section; 520—second guide groove; 521—U-shaped section; 522—second arc-shaped section; 530—third guide groove; 531—slope section; 532—third arc-shaped section; 540—fourth guide groove; 550—fifth guide groove; 600—adapting ring; 610—guide stem; 700—compound counter weight; 800—locking block; 810—spring.

DETAILED DESCRIPTION OF THE EMBODIMENTS

The following description is used to disclose the present disclosure such that those skilled in the art could realize the present disclosure. The preferred embodiments described below are given by way of example only, and other obvious modifications will occur to those skilled in the art.

Figure 2:
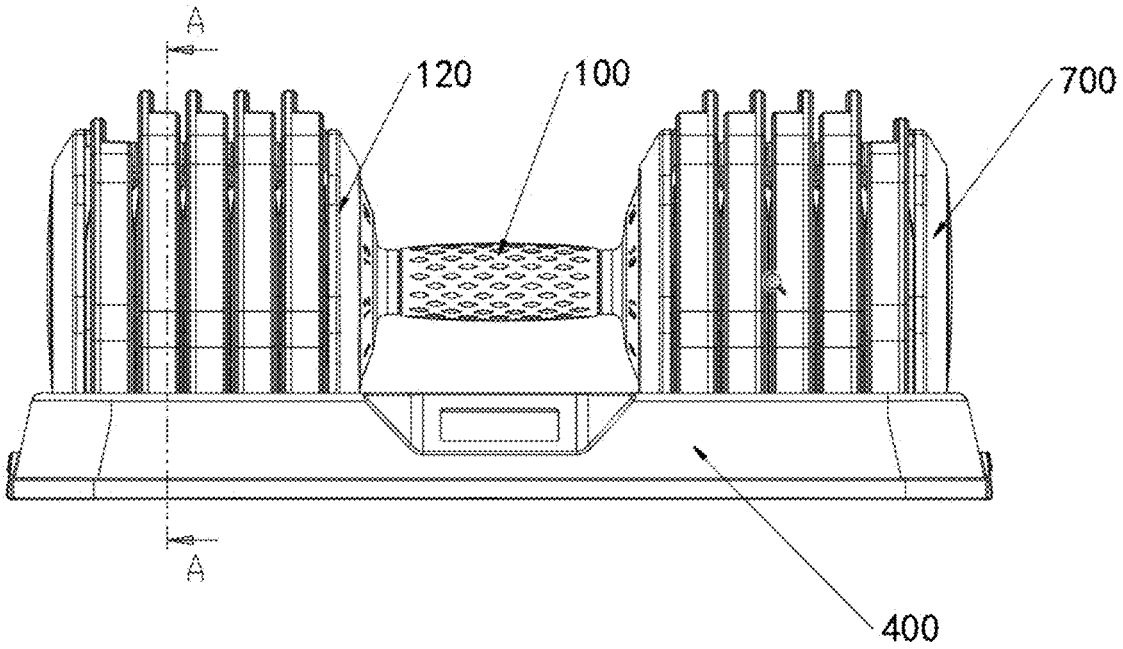
FIG. 2 is a schematic structural diagram of the dumbbell with conveniently assembled and disassembled counter weights of the present disclosure.
Figure 3:
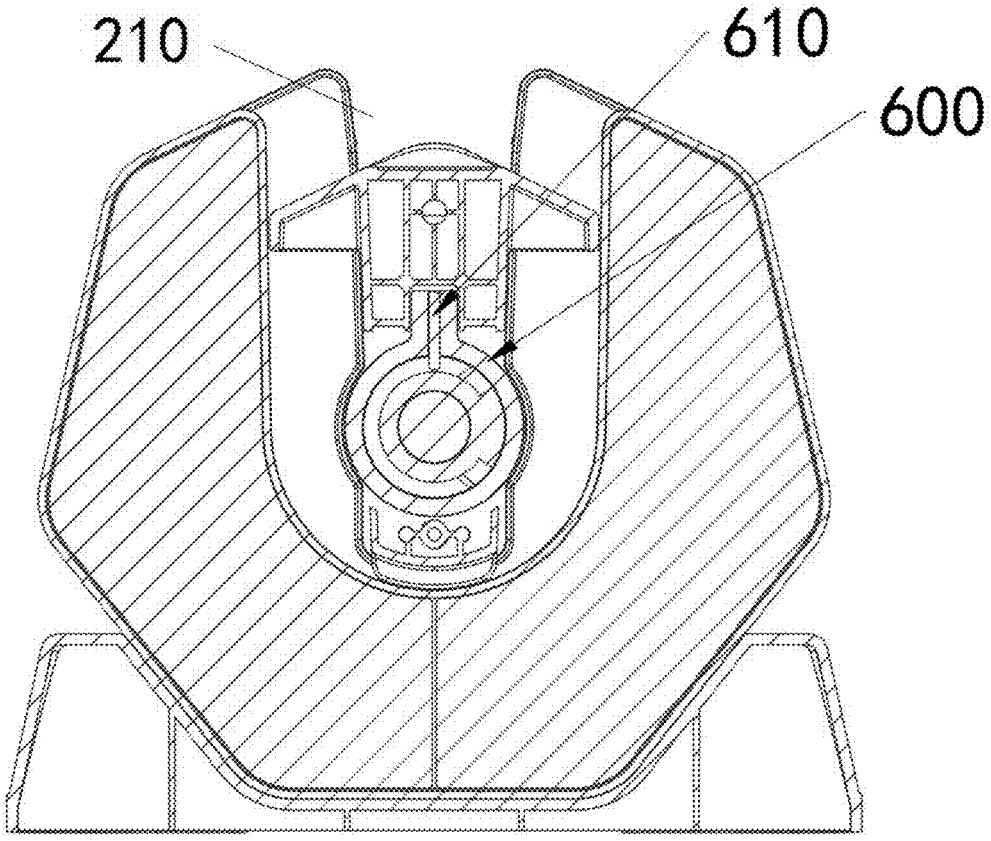
FIG. 3 is an A-A section view schematic structural diagram of FIG. 2.

As shown in FIG. 2 and FIG. 3, a dumbbell with conveniently assembled and disassembled counter weights includes a center rod 100 that provides a handheld area, where both ends of the center rod 100 are connected with the mounting bases 300 that are the same in structure and provided with counter weight mounting cavities, a pedestal 400 for placing the entire dumbbell, and the counter weights 200 placed on a surface of the pedestal 400. The center rod 200 is rotated to adjust the quantity of the counter weights 200 mounted in the mounting cavities of the mounting bases 300, so that different counter weights 200 are mounted or disassembled.

Specifically, as shown in FIG. 1, each of the mounting bases 300 is in a long columnar shape, a plurality of mounting cavities 310 for mounting the counter weights 200 are formed in an axial direction of each of the mounting bases, the mounting cavity 310 closest to the center rod 100 is regarded as a first mounting cavity, and the mounting cavities are regarded as a second mounting cavity, a third mounting cavity till the $N^{th}$ mounting cavity along the axis of the center rod. When the center rod 100 rotates for the first time, the first mounting cavity is assembled and connected with the counter weight 200. When the center rod rotates for a second time, the second mounting cavity is assembled and connected with the counter weight 200 in the corresponding position. All mounting cavities 300 are assembled and connected with the corresponding counter weights 200 in sequence through rotation of the center rod 100, and all mounting cavities 300 are assembled and connected to the counter weights 200 till the center rod 100 rotates one revolution. If it is needed to disassemble the counter weights 200, the center rod 100 is rotated reversely to achieve a disassembling action.

The dumbbell further includes a guide shaft body 500 that passes through the mounting bases 300 and is connected to the center rod 100, where a plurality of annular guide grooves are formed in a peripheral surface of the guide shaft body 500, the plurality of annular guide grooves are distributed in an axial direction of the guide shaft body, and each of the annular guide grooves corresponds to one mounting cavity; adapting rings 600 corresponding to the annular guide grooves are sleeved at the periphery of the guide shaft body 500, and the adapting rings 600 are used to mount the counter weights 200 and the mounting bases 300; and the adapting rings 600 are provided with guide stems 610, one end of each of the guide stems 610 cooperates with the corresponding annular guide groove, with rotation of the guide shaft body 500, each of the guide stems 610 drives each of the adapting rings 600 to change along a trend of the rabbet of the annular guide groove to be away from or close to the counter weight 200 needed to be assembled to assemble and disassemble each of the counter weights 200.

To improve the connecting fastness between the center rod 100 and the guide shaft body 500 and prevent the center rod 100 from being separated from the guide shaft body 500 in the rotating process, a square block 120 sleeved with the periphery of the center rod is additionally arranged on an end portion of the center rod 100, and a square through hole that cooperates with the square block 120 is arranged on an end portion of the guide shaft body 500, so that the center rod and the guide shaft body are connected and fixed.

Figure 4:
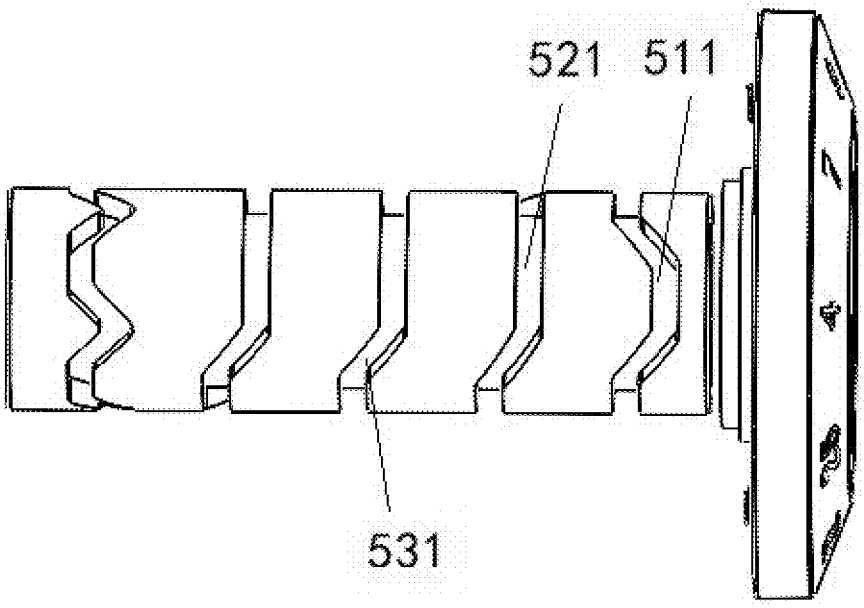
FIG. 4 is a schematic structural diagram of a guide shaft of the present disclosure from a first perspective.
Figure 5:
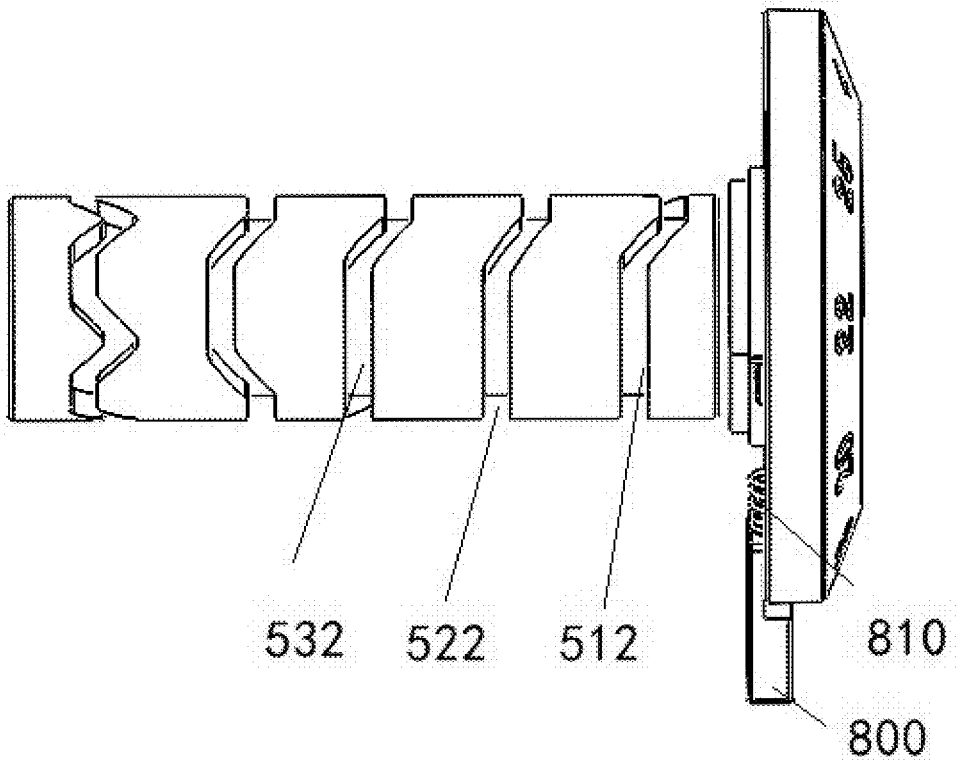
FIG. 5 is a schematic structural diagram of a guide shaft of the present disclosure from a second perspective.
Figure 6:
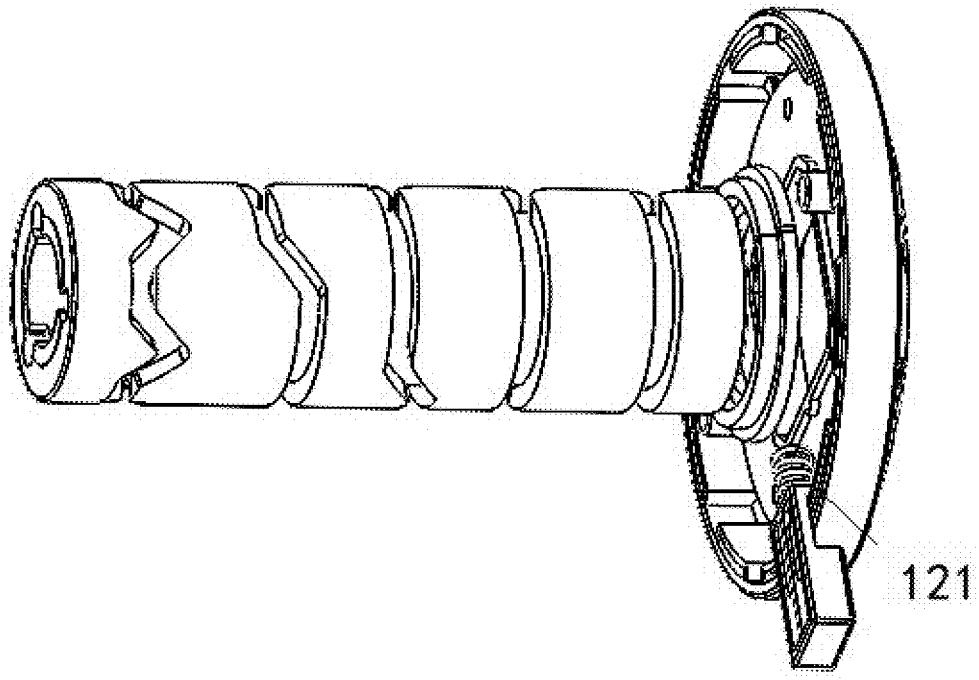
FIG. 6 is a schematic structural diagram of a guide shaft of the present disclosure from a third perspective.

In the embodiment, as shown in FIGS. 4-6, there are five annular guide grooves: the first guide groove 510, the second guide groove 520, the third guide groove 530, the fourth guide groove 540, and the fifth guide groove 550 in sequence from a direction close to the center rod 100 to a direction away from the center rod 100, where the first guide groove 510 is the annular guide groove formed by a V-shaped section 511 and a first arc-shaped section 512, and an opening of the V-shaped section 511 is directed to one end away from the center rod 100; the second guide groove 520 is the annular guide groove jointly formed by a U-shaped section 521 and a second arc-shaped section 512, where an opening of the U-shaped section 521 is directed to one end away from the center rod 100, the width of the opening of the U-shaped section 521 is greater than that of the V-shaped section 511, and the second guide groove is staggered with the first guide groove 510 in profile, so that a problem that as the two guide grooves are superposed, the counter weight is not hooked because the counter weight 200 fails to be hooked to one of the guide grooves is avoided; the third guide groove 530 is the annular guide groove jointly formed by a slope section 531 and a third arc-shaped section 532, where a direction of tilt of the slope section 531 is consistent with a direction of tilt of a vertical portion of the U-shaped section 521, and the slope section 531 is located on one side of the opening of the U-shaped section 521; the fourth guide groove 540 is as same as the second guide groove 520 in structure with opposite opening directions, and an opening of the fourth guide groove 540 and the opening of the second guide groove 520 are formed in a staggered manner and do not correspond to each other, so that the problem that the counter weights are not hooked is avoided; and the fifth guide groove 550 is in a fold line shape formed by connecting a plurality of V-shaped sections and U-shaped sections end to end to hook a compound counter weight 700; the weight of the compound counter weight 700 is less than the weight of the counter weight 200; when one counter weight 200 is light and the two counter weights 200 are heavy, the compound counter weight 700 is placed at a corresponding position of the fifth guide groove 550, so that the weight of the counter weight is between the weight of one counter weight and two counter weights, and more weights of the counter weights can be selected. Therefore, the applicability of the dumbbell is improved, and the dumbbell is more suitable for groups with multiple counter weight requirements.

It is shown here that the quantity of the annular guide grooves can be adjusted according to the quantity of the counter weights 200 needed to be assembled. If there are more counter weights 200 needed to be assembled, the quantity of the annular guide grooves is increased, and on the contrary, the quantity of the annular guide grooves is decreased.

In the embodiment, as shown in FIG. 3, a U-shaped notch 210 with a vertical inner wall is formed at the top of each of the counter weights 200, the U-shaped notch 210 is U-shaped, a concave arc is formed on the vertical inner wall, and openings of the concave arcs on both sides are formed oppositely to form an accommodating cavity for accommodating each of the adapting rings 600.

In the embodiment, end plates 120 with cavities are further arranged at both ends of the center rod 100, and adjusting pound numbers are carved on relative surfaces of the end plates 120, facilitating checking in an adjusting process; stopping blocks 121 uniformly distributed along a peripheral surface of an inner wall of each of the cavities of the end plates 120, where there is a gap between two adjacent stopping blocks 121; the dumbbell further includes a locking block 800 that cooperates with the gap, where one end of the locking block 800 is fixedly connected with a vertically upward spring 810, the vertically upward spring 810 is fixedly connected to the center rod 100, and the other end of the locking block 800 is in contact with an unlocking block (not shown in the drawing) of the pedestal 400; in an initial state, i.e., the counter weight 200 is placed on the pedestal 400, a bottom surface of the locking block 800 is in contact with the unlocking block, the unlocking block applies an upward force to the locking block 800, the locking block 800 is in a compressed state and is away from the gap between the two stopping blocks 121, and the center rod 100 can rotate; and when the dumbbell leaves the pedestal 400, the locking block 800 releases an elastic force downward under the action of the spring 810, and the locking blocks 800 fall into the gap between the two stopping blocks 121 to limit peripheral rotation of the center rod 100, so as to achieve an effect of locking the center rod 100.

The basic principle, main features, and advantages of the present disclosure are shown and described above. Those skilled in the art shall understand that the present disclosure is not subject to the limitation of the above-mentioned embodiments. The above-mentioned embodiments and description merely describe the principle of the present disclosure. There will be various variations and improvements of the present disclosure without departing from the spirit and scope of the present disclosure and these variations and improvements shall fall into the claimed scope of the present disclosure. Therefore, the claimed protection scope of the present disclosure shall be defined by the appended claims and equivalents thereof.

What is claimed is:

1. A guide shaft, comprising:

a guide shaft body, wherein at least two annular guide grooves and a counter weight guide groove distributed in an axial direction of the guide shaft body are formed in a peripheral surface of the guide shaft body;

an adapting rings configured to engage a counter weight and being away from or close to a counter weight needed to be assembled to assemble and disassemble the counter weight; and a center rod that provides a handheld area, wherein both ends of the center rod are connected with mounting bases that are the same in structure and provided with counter weight mounting cavities, a pedestal for placing an entire dumbbell, and the counter weights placed on a surface of the pedestal, each of the mounting bases is provided with a plurality of mounting cavities arranged in an axial direction of the mounting base to mount the counter weights, and the counter weights and the mounting cavities are hooked or disassembled through rotation of the center rod;

end plates with cavities are further arranged at both ends of the center rod, and adjusting pound numbers are carved on relative surfaces of the end plates, facilitating checking in an adjusting process; stopping blocks uniformly distributed along a peripheral surface of an inner wall of each of the cavities of the end plates, where there is a gap between two adjacent stopping blocks; wherein there are five annular guide grooves: a first guide groove, a second guide groove, a third guide groove, a fourth guide groove, and a fifth guide groove in sequence, distributed from a direction close to a center rod to a direction away from the center rod;

the first guide groove is the annular guide groove jointly formed by a V-shaped section and a first arc-shaped section, and an opening of the V-shaped section is directed to one end away from the center rod;

the second guide groove is the annular guide groove jointly formed by a U-shaped section and a second arc-shaped section, an opening of the U-shaped section is directed to one end away from the center rod, the width of the opening of the U-shaped section is greater than that of the V-shaped section, and the second guide groove is staggered with the first guide groove in profile;

the third guide groove is the annular guide groove formed by a slope section and a third arc-shaped section, a direction of tilt of the slope section is consistent with a direction of tilt of a vertical portion of the U-shaped section, and the slope section is located on one side of the opening of the U-shaped section;

the fourth guide groove is as same as the second guide groove in structure with opposite opening directions, and an opening of the fourth guide groove and the opening of the second guide groove are formed in a staggered manner;

the fifth guide groove is in a fold line shape formed by connecting a plurality of V-shaped sections and U-shaped sections end to end to hook a compound counter weight; and the counter weight guide groove is the fifth guide groove;

the adapting rings correspond to the annular guide grooves of the guide shaft and are provided with guide stems assembled with the annular guide grooves to engage counter weights and mounting bases;

each of the guide stems connected to each of the adapting rings; one end of the guide stem cooperates with the corresponding annular guide groove; and with rotation of the guide shaft, the guide stem drives each of adapting ring to change along a trend of a rabbet of the annular guide groove to be away from or close to the counter weight needed to be assembled to assemble and disassemble each of the counter weights; and a notch with a vertical inner wall is formed at the top of each of the counter weights, a concave arc is formed on the vertical inner wall, and openings of the concave arcs on both sides are formed oppositely to form an accommodating cavity for accommodating each of the adapting rings.

* * * * *